United States Patent [19]

Morrison

[11] Patent Number: 4,633,539

[45] Date of Patent: Jan. 6, 1987

[54] APPARATUS FOR ALTERING THE CONTOUR OF A MATTRESS ON A BED

[75] Inventor: Ronald F. Morrison, Helensburgh, United Kingdom

[73] Assignee: Orthomatic Limited, Yoker, United Kingdom

[21] Appl. No.: 706,508

[22] Filed: Feb. 28, 1985

[51] Int. Cl.[4] ..... A61G 7/06; A47C 20/04

[52] U.S. Cl. ..... 5/508; 5/71; 5/72; 5/79; 5/81 R; 5/433

[58] Field of Search ..... 5/508, 70, 71, 72, 74 R, 5/74 B, 79, 158, 149, 432, 433, 81 R

[56] References Cited

U.S. PATENT DOCUMENTS

| | | | |
|---|---|---|---|
| 258,059 | 5/1882 | Hallmeimer | 5/158 |
| 521,595 | 6/1894 | Nye | 5/158 |
| 915,651 | 3/1909 | Appel | 5/158 |
| 972,713 | 10/1910 | Palmer | 5/433 |
| 1,121,636 | 12/1914 | Kreczkowski | 5/158 |

*Primary Examiner*—Alexander Grosz

*Attorney, Agent, or Firm*—Killworth, Gottman, Hagan & Schaeff

[57] ABSTRACT

Apparatus for altering the contour of a mattress on a bed comprises a lifting and lowering device located, in use, at one end of the bed and carrying an attachment for generally vertical movement. A flexible elongated carrier for a mattress has one end hinged to the attachment, and is movable between a first contour, where the attachment is in a lower position and the carrier is disposed wholly in a generally horizontal plane, and a second contour where the attachment is in an upper position, the end of the carrier hinged to the attachment is spaced above the aformentioned horizontal plane and the opposite end of the carrier, together with an adjacent, substantial portion of the carrier, is disposed in said generally horizontal plane. Friction-reducing means facilitates movement of the carrier in the horizontal plane.

6 Claims, 2 Drawing Figures

12
13
14
6
9
10
11
2
3
4
5
7
8
S

APPARATUS FOR ALTERING THE CONTOUR OF A MATTRESS ON A BED

BACKGROUND OF THE INVENTION

This invention relates to an apparatus intended for altering the contour of a mattress on a bed.

Such apparatus is known using a lever system but suffers from the disadvantages that bedclothes and fingers can become ensnared in the mechanism.

An object of the invention is to obviate or mitigate the above disadvantage.

SUMMARY OF THE INVENTION

According to the invention there is provided apparatus for altering the contour of a mattress on a bed, the apparatus comprising a lifting and lowering device located, in use, at one end of the bed and carrying an attachment for movement in a substantially vertical plane between a lower position and an upper position, a flexible elongate carrier for a mattress and having one end hingedly attached to the attachment, the carrier being movable between a first contour where the attachment is in its lower position and the carrier is supported wholly in a substantially horizontal plane and a second contour where the attachment is in its upper position, the one end of the carrier is spaced above the substantially horizontal plane and the opposite end of the carrier, together with an adjacent substantial portion of the carrier, is supported in the substantially horizontal plane, and friction-reducing means for facilitating movement of the carrier in the substantially horizontal plane.

BRIEF DESCRIPTION OF THE DRAWINGS

Embodiments of the invention will now be described, by way of example, with reference to the accompanying diagrammatic drawing, in which.

DETAILED DESCRIPTION OF THE PREFERRED EMBODIMENTS

Figures 1, 2:
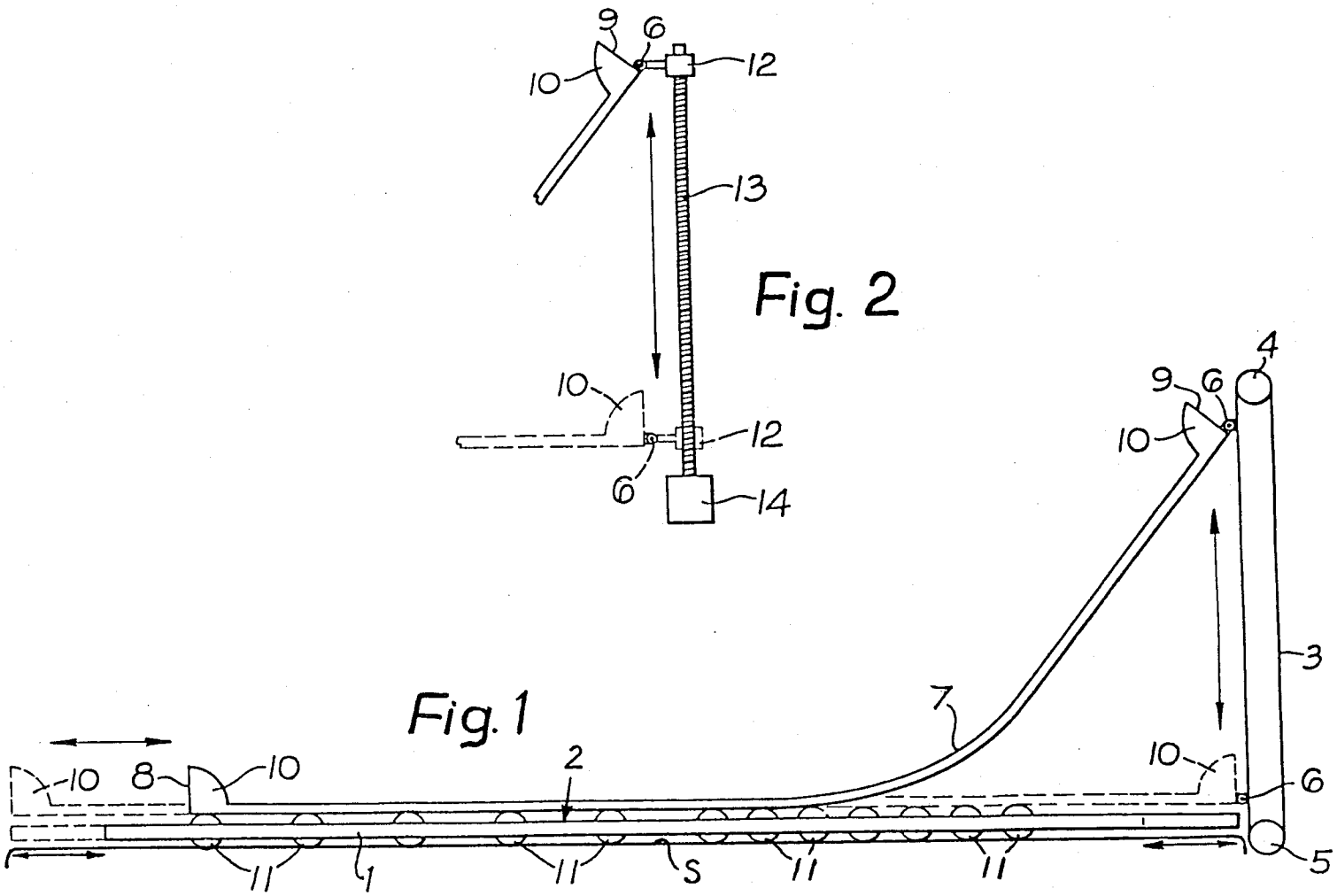
FIG. 1 shows one embodiment of the invention.
FIG. 2 shows a modification of the embodiment of FIG. 1.

In FIG. 1, a sheet 1 presents an upper support surface 2 and, in use, occupies a horizontal plane resting on the generally horizontal supporting surface S for the mattress of a bed. A lifting and lowering device can be embodied in a headboard or head frame of the bed and comprises a wide endless band 3 trained about upper and lower horizontal rollers 4 and 5. The band 3 carries an attachment 6 for movement in a vertical plane between upper and lower positions. A flexible carrier 7 overlies the support surface 2 and has at each end an upstanding end wall 8, 9 with corner fillets 10 to support and locate a mattress (not shown). The end wall 9 is hingedly attached to the attachment 6 and friction reducing means in the form of rollers 11 are embodied in the sheet 1.

In use, the contour of the carrier 7 and thus of the mattress it carries can be altered by raising and lowering the end wall 9 of the carrier 7. When the end wall 9 is fully raised, as shown in full lines, the mattress is in a contour enabling the occupant to sit in the bed, the end wall 8 of the carrier 7 having slid along the sheet 1 and the sheet having slid along the bed towards the head of the bed. When the end wall 9 is fully lowered, as shown in broken lines, the mattress is fully horizontal with the end wall 8 and the sheet 1 having been slid back to the foot of the bed.

The lifting and lowering device can be at the foot of the bed. Alternatively, lifting and lowering devices can be at both the head and the foot of the bed with only one of the end walls 8 and 9 at a time attached to the associated device. One of the rollers 4 and 5, preferably the roller 5, can be driven electrically and provided with limit switches to prevent the attachment 6 being lifted or lowered too far. Alternatively, a manual cranking system may be used. Means may also be provided to maintain the tension in the band 3 by adjusting the spacing between the rollers 4 and 5.

Another form of lifting and lowering device is shown in FIG. 2 where the attachment 6 is attached to a nut 12 which can move up and down a vertical elongate screw-threaded rod 13 driven by an electric motor 14. Limit switches may also be used here and the electric motor may be replaced by a manual cranking system.

The rollers 11 may instead be embodied in the carrier 7. Alternatively the rollers 11 may be replaced by a friction-reducing powder.

While the form of apparatus herein described constitutes a preferred embodiment of the invention, it is to be understood that the invention is not limited to this precise form of apparatus, and that changes may be made therein without departing from the scope of the invention, as defined in the appended claims.

I claim:

1. Apparatus for altering the contour of a mattress on a bed having generally horizontal supporting surface means for said mattress extending longitudinally between opposite ends of said bed, said apparatus comprising:

elevating and lowering means adapted to be mounted at an end of said bed, attachment means carried by said elevating and lowering means for movement thereby in a generally vertical plane between a lower position adjacent said mattress supporting surface means and an upper position, flexible elongate carrier means for said mattress adapted to be supported by said supporting surface means, with opposite ends of said carrier means adjacent said opposite ends of said bed, and to be longitudinally movable relative to said supporting surface means, hinge means connecting the end of said carrier means adjacent said elevating and lowering means to said attachment means, said elevating and lowering means being operable to adjust said carrier means between a first contour in which the said attachment means is in its lower position and said carrier means is supported by said supporting surface means wholly in a generally horizontal plane and a second contour in which said attachment means is in its upper position and said adjacent end of said carrier means is spaced above said supporting surface means while the opposite end of said carrier means, together with a substantial portion of said carrier means adjacent said opposite end, remains supported by said supporting surface means in said generally horizontal plane, and friction reducing means for facilitating longitudinal movement of said carrier means relative to said supporting surface means.

2. The apparatus claimed in claim 1, wherein said elevating and lowering means comprises a wide endless band trained about two rollers and carrying said attachment means.

3. The apparatus claimed in claim 1, wherein said elevating and lowering means comprises an elongate rotatable screw-threaded rod mounted in a generally vertical position, and a nut carrying said attachment means threaded on said rod.

4. The apparatus according to claim 1, wherein said friction reducing means comprises rollers.

5. The apparatus claimed in claim 4, including sheet means adapted to be disposed generally horizontally on said mattress supporting surface means and to present a support surface for said carrier means, said friction reducing rollers being arranged between said sheet means and said carrier means.

6. Apparatus for altering the contour of a mattress on a bed having generally horizontal supporting surface means for said mattress extending longitudinally between opposite ends of said bed, said apparatus comprising:

elevating and lowering means adapted to be mounted at an end of said bed and including a wide endless band trained about two rollers disposed in generally vertically spaced relation, attachment means carried by said band for movement thereby in a generally vertical plane between a lower position adjacent said mattress supporting surface means and an upper position, flexible elongate carrier means for said mattress and of generally similar length to said mattress, said carrier means being adapted to be supported by said supporting surface means, with opposite ends of said carrier means adjacent said opposite ends of said bed, and to be longitudinally movable relative to said supporting surface means, hinge means connecting the end of said carrier means adjacent said elevating and lowering means to said attachment means, sheet means disposable beneath said carrier means and adapted to rest on said mattress supporting surface means to provide a support for said carrier means, and friction reducing means arranged between said carrier means and said sheet means for facilitating longitudinal movement of said carrier means generally horizontally, said elevating and lowering means being operable to move said band and thereby adjust said carrier means between a first contour in which said attachment means is in its lower position and said carrier means is supported by said supporting surface means wholly in a generally horizontal plane and a second contour in which said attachment means is in its upper position and said adjacent end of said carrier means is spaced above said generally horizontal plane while the opposite end of said carrier means, together with a substantial portion thereof adjacent said opposite end, remains disposed in said generally horizontal plane.

* * * * *